US012710242B2

(12) United States Patent
Peterson

(10) Patent No.: US 12,710,242 B2
(45) **Date of Patent: *Aug. 18, 2026**

(54) FIREARM LOCKING DEVICE

(71) Applicant: Donald J. Peterson, Vero Beach, FL (US)

(72) Inventor: Donald J. Peterson, Vero Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/012,089

(22) Filed: Jan. 7, 2025

(65) Prior Publication Data

US 2025/0146777 A1 May 8, 2025

Related U.S. Application Data

(63) Continuation of application No. 18/092,251, filed on Dec. 31, 2022, now Pat. No. 12,215,940.

(60) Provisional application No. 63/329,910, filed on Apr. 12, 2022, provisional application No. 63/361,232, filed on Jan. 3, 2022.

(51) Int. Cl.
*F41A 17/44* (2006.01)

(52) U.S. Cl.
CPC ..... *F41A 17/44* (2013.01)

(58) Field of Classification Search
CPC ..... F41G 11/003; F41G 11/001; F41G 1/38; F41G 1/387; F41G 1/393; F41G 1/40; F41G 1/41
See application file for complete search history.

(56) References Cited

U.S. PATENT DOCUMENTS

D257,687 S * 12/1980 Bechtel ..... D22/108
4,384,420 A * 5/1983 Von Muller ..... F41A 17/02 42/70.11
4,528,765 A * 7/1985 Johnson ..... F41A 17/44 42/70.11
4,532,729 A * 8/1985 Von Muller ..... F41A 17/02 42/70.11
4,709,496 A * 12/1987 Johnson ..... F41A 17/44 42/70.11
6,052,934 A * 4/2000 Carpenter ..... F41A 17/44 42/70.11
6,256,919 B1 * 7/2001 Brazeau ..... F41A 17/44 42/70.11
6,256,920 B1 * 7/2001 Olson ..... F41A 17/44 42/70.11
7,543,403 B1 * 6/2009 Schaefer ..... F41A 17/02 42/70.11
8,931,201 B2 * 1/2015 Gianladis ..... F41A 23/18 42/94
D738,984 S * 9/2015 Mayberry ..... D22/108
10,203,176 B1 * 2/2019 Peterson ..... F41A 17/44
10,422,601 B2 * 9/2019 Harris ..... F41A 9/65
10,488,142 B2 * 11/2019 Jacobson ..... F41A 23/18
11,788,812 B1 * 10/2023 Harrison ..... F41A 23/18 42/94
2010/0199540 A1 * 8/2010 Bentley ..... F41A 17/42 42/70.11
2015/0290775 A1 * 10/2015 Bennett ..... B25B 11/00 269/287
2017/0146310 A1 * 5/2017 Biran ..... F41A 17/066
(Continued)

*Primary Examiner* — Joshua E Freeman
(74) *Attorney, Agent, or Firm* — CF3; Stephen Eisenmann

(57) ABSTRACT

A device including a body coupled to a magazine receiving area of a firearm and a locking unit that locks a firearm to the body of the device.

13 Claims, 13 Drawing Sheets

(56) References Cited

U.S. PATENT DOCUMENTS

| | | | | |
|---|---|---|---|---|
| 2017/0241730 | A1* | 8/2017 | Ochoa | F41A 17/44 |
| 2018/0238650 | A1* | 8/2018 | Stockton | F41A 17/44 |
| 2022/0412685 | A1* | 12/2022 | Dugan | F41A 33/00 |

* cited by examiner

FIREARM LOCKING DEVICE

The present application claims priority to and is a continuation of U.S. patent application Ser. No. 18/092,251, filed on Dec. 31, 2022 which claims priority to U.S. provisional patent application Ser. No. 63/361,232, filed on Jan. 3, 2022 and U.S. provisional patent application Ser. No. 63/329,910, filed on Apr. 22, 2022, which are incorporated in their entirety herein by reference.

1. BACKGROUND

2. Field

This disclosure relates to systems, devices, and methods for use in safely guarding, monitoring, and/or holding a firearm in vehicles, buildings, homes, storage, and/or any other location.

This disclosure relates to a mounted and/or secured device which interacts with the firearm and locks the firearm in an accessible location. This mounted and/or secured device allows the operator to secure/release the firearm by operating the locking/unlocking unit with minimal effort (e.g., one hand). In law enforcement, home protection, and/or military applications it is desirable to have a firearm held securely within arm's reach but also quickly locked or unlocked when required. The firearm is held securely and the operator may keep their hands free to perform other tasks, (e.g., driving, paperwork, housework, navigation, radio operating, etc.), but still have the firearm readily accessible in a timely manner.

BRIEF DESCRIPTION OF THE DRAWINGS

The disclosure may be understood by reference to the following description taken in conjunction with the accompanying drawings, in which like reference numerals identify like elements, and in which.

Figure 1:
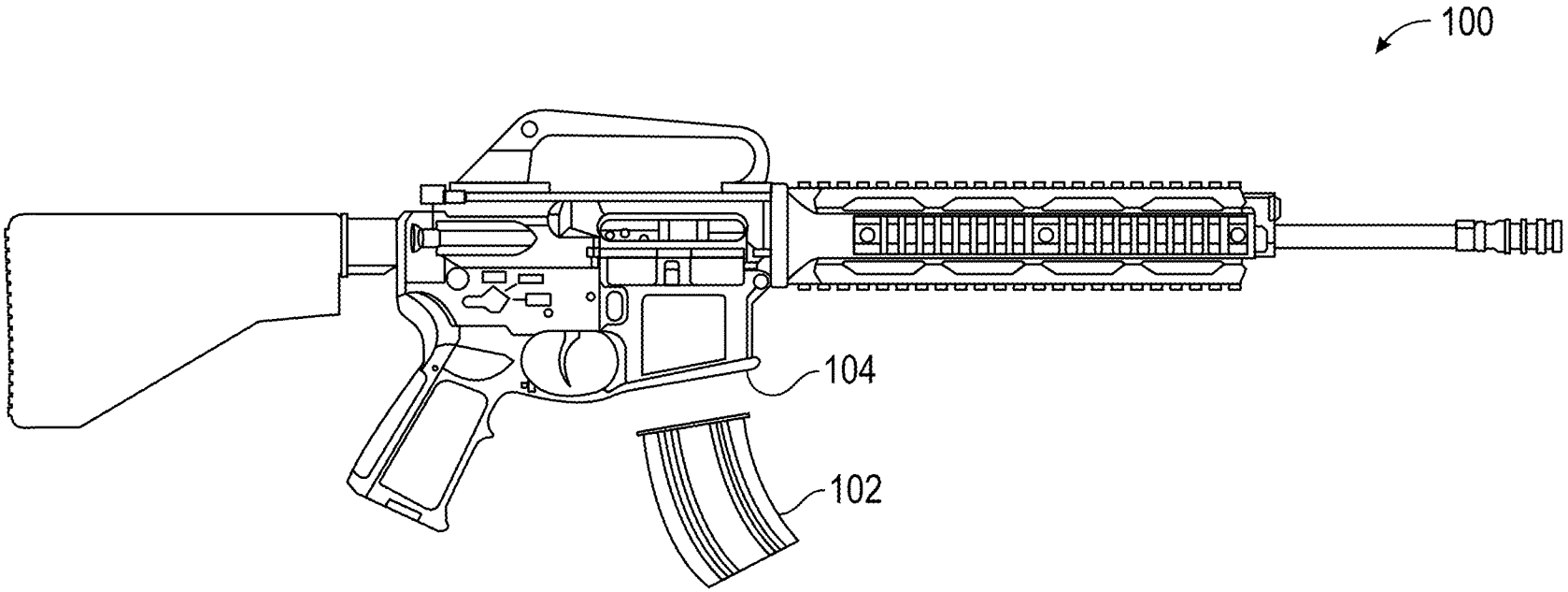
FIG. 1 is an illustration of a firearm, according to one embodiment.

While the disclosure is susceptible to various modifications and alternative forms, specific embodiments thereof have been shown by way of example in the drawings and are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION OF SPECIFIC EMBODIMENTS

Illustrative embodiments of the disclosure are described herein. In the interest of brevity and clarity, not all features of an actual implementation are described in this specification. In the development of any such actual embodiment, numerous implementation-specific decisions must be made to achieve the design-specific goals, which will vary from one implementation to another. It will be appreciated that such a development effort, while possibly complex and time-consuming, would nevertheless be a routine undertaking for persons of ordinary skill in the art having the benefit of this disclosure.

This document does not intend to distinguish between components that differ in name but not function. In the following discussion and in the claims, the terms "including" and "includes" are used in an open-ended fashion, and thus should be interpreted to mean "including, but not limited to." Also, the term "couple" or "couples" is intended to mean either a direct or an indirect connection (e.g., electrical, mechanical, etc.). "Direct contact," "direct attachment," or providing a "direct coupling" indicates that a surface of a first element contacts the surface of a second element with no substantial attenuating medium there between. The presence of small quantities of substances that do not substantially attenuate electrical connections does not vitiate direct contact. The word "or" is used in the inclusive sense (i.e., "and/or") unless a specific use to the contrary is explicitly stated.

The particular embodiments disclosed above are illustrative only as the disclosure may be modified and practiced in different but equivalent manners apparent to those skilled in the art having the benefit of the teachings herein. Furthermore, no limitations are intended to the details of construction or design herein shown other than as described in the claims below. It is, therefore, evident that the particular embodiments disclosed may be altered or modified and all such variations are considered within the scope and spirit of the disclosure. Accordingly, the protection sought herein is as set forth in the claims below.

All locations, sizes, shapes, measurements, ratios, amounts, angles, component or part locations, configurations, dimensions, values, materials, orientations, etc. discussed or shown in the drawings are merely by way of example and are not considered limiting and other locations, sizes, shapes, measurements, ratios, amounts, angles, component or part locations, configurations, dimensions, values, materials, orientations, etc. can be chosen and used and all are considered within the scope of the disclosure.

Dimensions of certain parts as shown in the drawings may have been modified and/or exaggerated for the purpose of clarity of illustration and are not considered limiting.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, machine learning devices, smart phones, smart watches, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," "another example," "in addition," "further," and/or any similar language should be considered to mean that the particular features, structures, or characteristics may be combined in any and all examples in this disclosure. Any combination of any element in this disclosure with any other element in this disclosure is hereby disclosed.

In one embodiment, a mount for holding and locking a firearm with the firearm having a magazine well and a magazine locking catch extendable through a catch opening into the magazine for locking a magazine in the magazine well is utilized. The mount has a surface mountable base and a generally perpendicular extending support mounted to the base. The top portion support is configured to extend into the magazine well of the firearm and has the characteristics of the magazine for the subject firearm. A mount pin is slidably mounted within the top portion of the support and has a first position allowing unlimited movement of the magazine locking catch through the catch opening of the firearm, thus allowing the magazine latching catch to engage the mount in the same manner as it would engage a magazine. The second position of the mount pin engages the magazine locking catch of the firearm pushing the catch from the magazine well into the catch opening of the firearm magazine well which locks the mount to the weapon by preventing the removal of the firearm from the support. A mechanism moves the mount pin from the first position to the second position by the operator when a locking condition is engaged.

In FIG. 1, an illustration of a firearm is shown, according to one embodiment. A firearm 100 may include a magazine 102 and a magazine receiving area 104 (e.g., magazine well). The magazine 102 is a bullet storage device, which also delivers bullets to the firearm via the bolt carrier. Further, the magazine receiving area 104 is an area of the firearm where the magazine 102 is inserted into and locks into position to deliver one bullet at a time to a gun chamber. In one example, a bullet is delivered from the magazine 102 to a gun chamber via a bolt carrier.

In one embodiment, the firearm mounting device may be used with a magazine-fed firearm with a detachable magazine (e.g., magazine 102) and a spring loaded catch engaging the exterior wall of the magazine and may be used to latch or hold the firearm to the mount after the magazine 102 is removed from the firearm. The firearm mounting device holds the firearm with the ability to release the firearm with a push of the magazine release button when the firearm mounting device is in the unlocked state. In addition, the bolt blocking unit (see FIGS. 3A to 10) prevents weapon discharge.

Figure 2A:
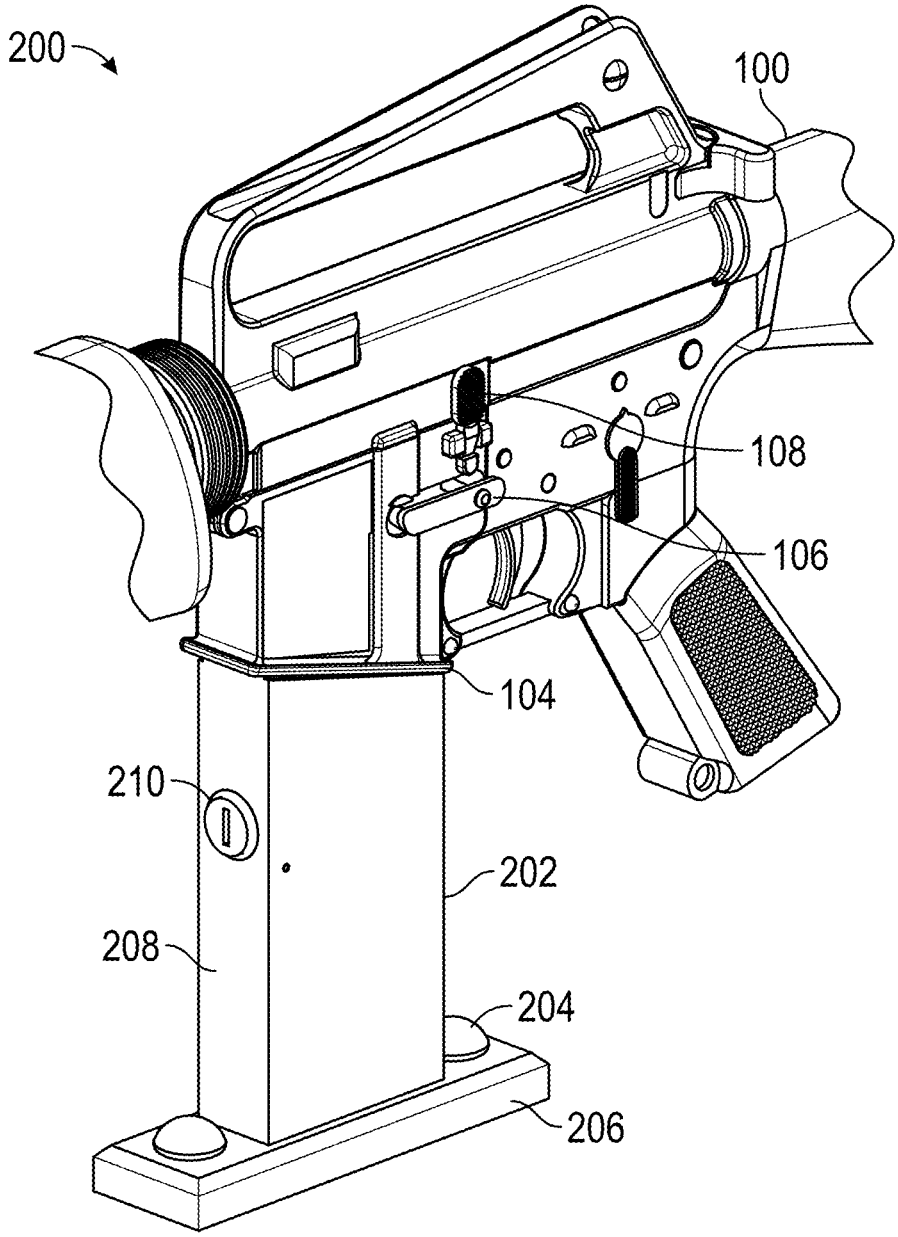
FIGS. 2A-2C are illustrations of the firearm locking device and a firearm, according to various embodiments.
Figure 2B:
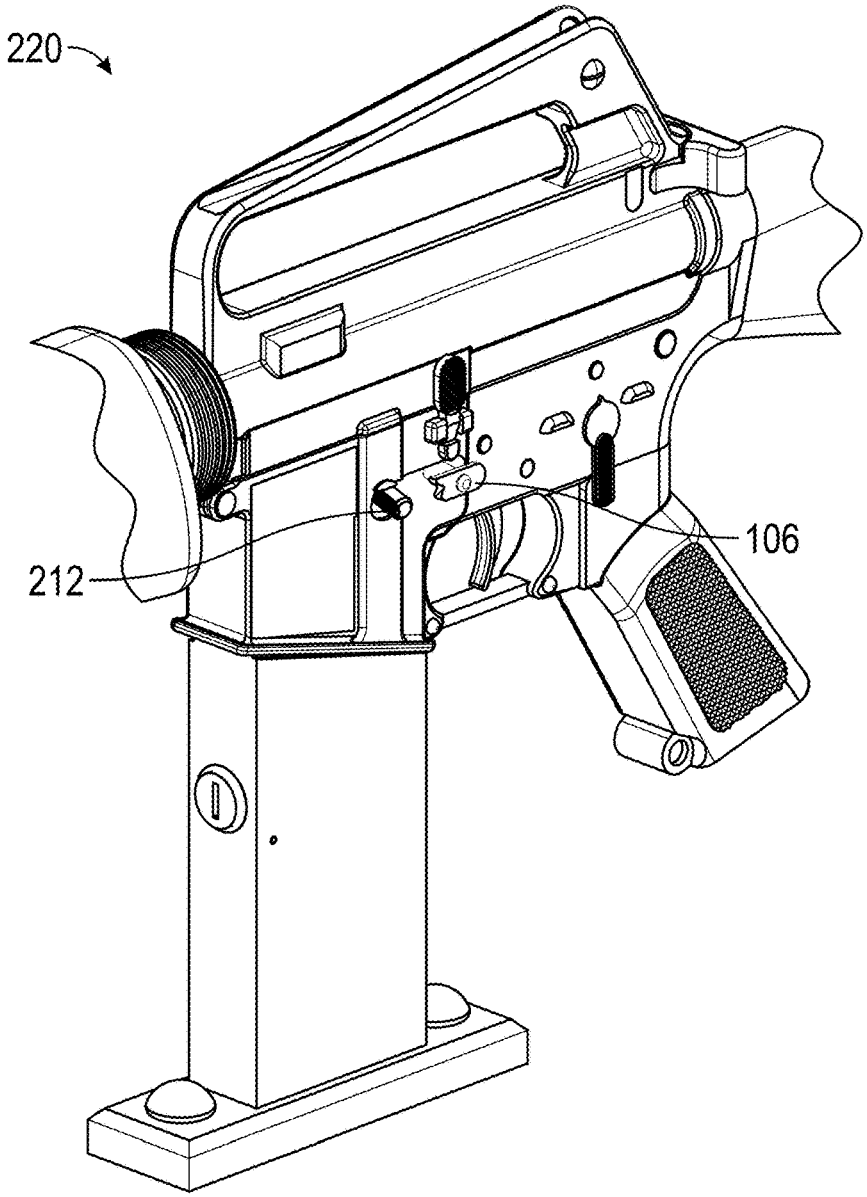
Figure 2C:
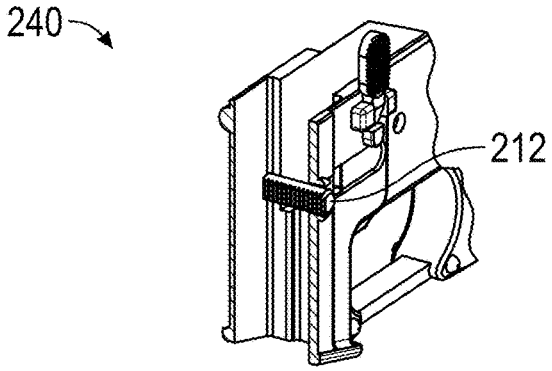

In FIGS. 2A-2C, illustrations of the firearm locking device and a firearm are shown, according to various embodiments. FIG. 2A shows a combination 200 of the firearm 100 and a firearm locking device 202. In this example, the firearm 100 includes the magazine receiving area 104, a magazine release lever 106, and/or a bolt release 108. In this example, the firearm locking device 202 includes a base 206, a body 208, and a locking device 210. Further, the firearm locking device 202 may include one or more securing devices 204 (e.g., bolts, screws, glue, etc.) to secure the firearm locking device 202 to one or more surfaces (e.g., wall, door, part of a vehicle, desk, table, etc.).

In one example, the base 206 may be locked onto a surface via the one or more securing devices 204. For example, the base 206 may be secured via the one or more securing devices 204 to a portion of a vehicle, a desk, a wall, and/or any other location where the firearm 100 needs to be stored securely but readily available as needed. The lower body of the mount may have a plane mounting bracket for attachment to a surface with anti-tamper fasteners or any method to make removal difficult.

FIG. 2B shows a magazine release lever 106 of the firearm 100 and an upper rack 212 of the firearm locking device 202. In one example, the upper rack 212 is locked into place and/or coupled to the magazine release lever 106. Further, the magazine release lever 106 will disengage with the firearm locking device 202 when the magazine release lever 106 is depressed and the firearm locking device 202 is in an unlocked state.

In another example, when the firearm locking device is in a locked state, the upper rack 212 goes through a hole in the magazine well's inner wall which limits the movement of the firearm 100 in relation to the firearm locking device 202. In one example, even if the magazine release lever is pressed, the firearm 100 will not be released because the upper rack 212 will still be engaged (because the upper rack 212 will not move even if the magazine release lever is pressed) with the firearm 100 via the hole in the magazine's well's inner wall. Therefore, the firearm 100 cannot be released from the firearm locking device 202 when the firearm locking device 202 is in a locked state. In one example, even if the magazine release lever is pressed, the firearm 100 will not be released because the upper rack 212 will still be engaged (because the upper rack 212 will not move even if the magazine release lever is pressed) with the firearm 100 via the hole in the magazine's well's inner wall. Therefore, the firearm 100 cannot be released from the firearm locking device 202 when the firearm locking device 202 is in a locked state.

FIG. 2C shows a detailed view of the upper rack 212 of the firearm locking device 202. In this detailed example, the upper rack 212 is locked into place and/or coupled to the magazine release lever 106. Further, the magazine release lever 106 will disengage with the firearm locking device 202 when the magazine release lever 106 is depressed and the firearm locking device 202 is in an unlocked state. In another example, when a magazine is inserted into the magazine well, the magazine will be caught by a lever in the magazine well. The lever limits the movement of the magazine in the magazine well. However, once the magazine release lever 106 is pressed the lever will be withdrawn and the magazine will be able to be removed from the magazine well. In a similar fashion, when the firearm locking device 202 is in an unlocked state and the magazine release lever 106 is pressed, the firearm 100 will be able to be disengaged from the firearm locking device 202.

In one embodiment, a bolt carrier catch mechanism is utilized, which allows the weapon bolt to be locked to the rear when installed on a magazine well locking device suitable for any magazine-fed firearm with a detachable magazine that has a spring loaded catch engaging the exterior wall of the magazine. In addition, a method for securing or positioning the firearm in the device in order to protect against unauthorized handling, firing, theft, or other unauthorized use involving a lever or pin that displaces the magazine catch, and thereby secures the firearm to the device. In another example, a method to lock or hold the lever or pin in the desired position is utilized, thus preventing the firearm from being disengaged from the device.

Figure 3B:
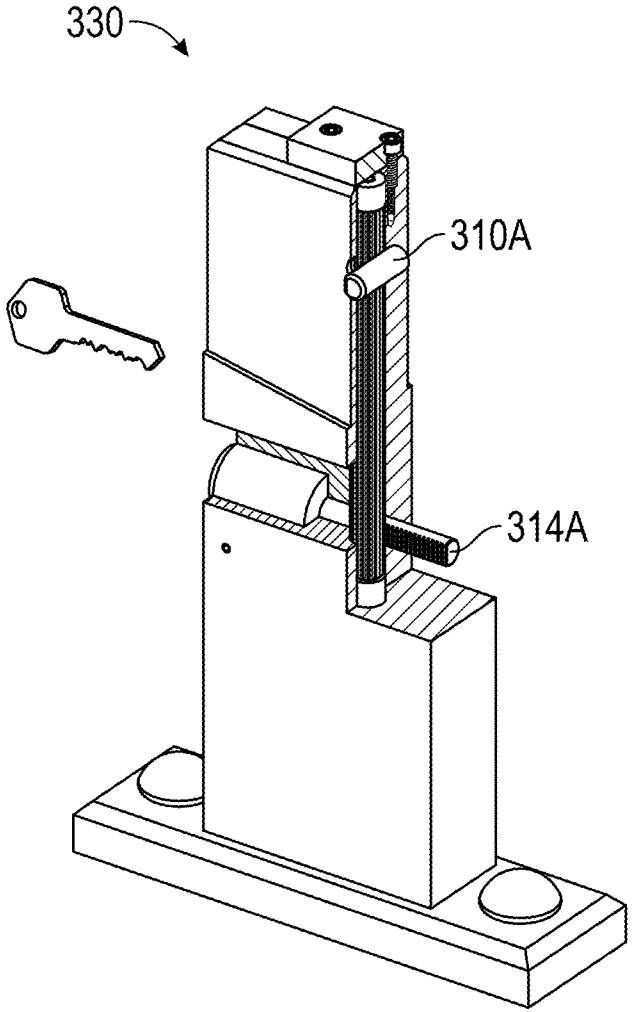
FIGS. 3A-3B are illustrations of the firearm locking device, according to one embodiment.
Figure 3A:
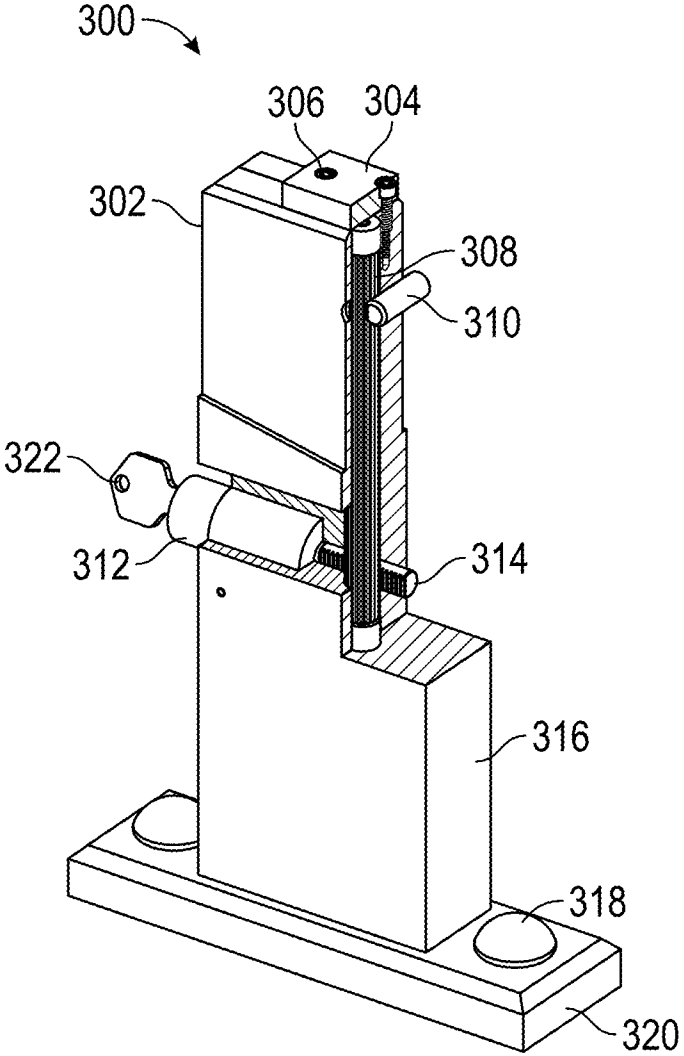

In FIGS. 3A-3B, illustrations of the firearm locking device are shown, according to various embodiments. In FIG. 3A, an image 300 of a firearm locking device 302 is shown. In one example, the firearm locking device 302 includes a portion of a carrier bolt blocking unit 304, an attachment 306 for securing the carrier bolt blocking unit 304 to the firearm locking device 302, a pinion 308, an upper rack 310, a locking unit 312 (e.g., a plunger lock), a lower rack 314, a key 322 (and/or any other method of locking and unlocking the locking unit (e.g., pass code, biometric data, fingerprint, face recognition, etc.)), and/or a second attachment 318 for securing a locking device base 320 to a surface and/or another device.

In one example of the rack and pinion action, the locking unit 312 may engage with (e.g., move, push, apply force, etc.) the lower rack 314 which engages with the pinion 308 causing the pinion 308 to rotate due to the gear interaction between the lower rack 314 and the pinion 308. Simultaneously, the upper rack 310 is moved outwards due to the gear interaction between the gears and pinion 308. In one example, the upper rack 310 pushes the magazine release lever 106 outwards and occupies the hole in the side of the upper receiver pin and makes the gun unremovable from the lock assembly. In one example, when the key 322 for the lock is rotated 90 degrees and is in a locked state, the firearm 100 is locked to the firearm locking device 302 and the firearm 100 cannot be removed. In one example, to place the firearm locking device 302 in an unlocked state; the key 322 is required to reverse the movement of the upper rack 310, the pinion 308, and/or the lower rack 314. In various examples, the locking unit 312 may be a key-type lock, a biometric-type lock, a code-type lock, and/or any other locking device.

In one example, the firearm locking device 302 is shown in an unlocked position in FIG. 3A. Whereas, the firearm locking device 302 is shown in a locked position in FIG. 3B. In the example shown in FIG. 3B, the locking unit 312 has moved the lower rack 314 to a lower rack locked position 314A, which moves the pinion 308 via the gears. This gear action then moves the upper rack 310 to an upper rack locked position 310A.

Figure 4A:
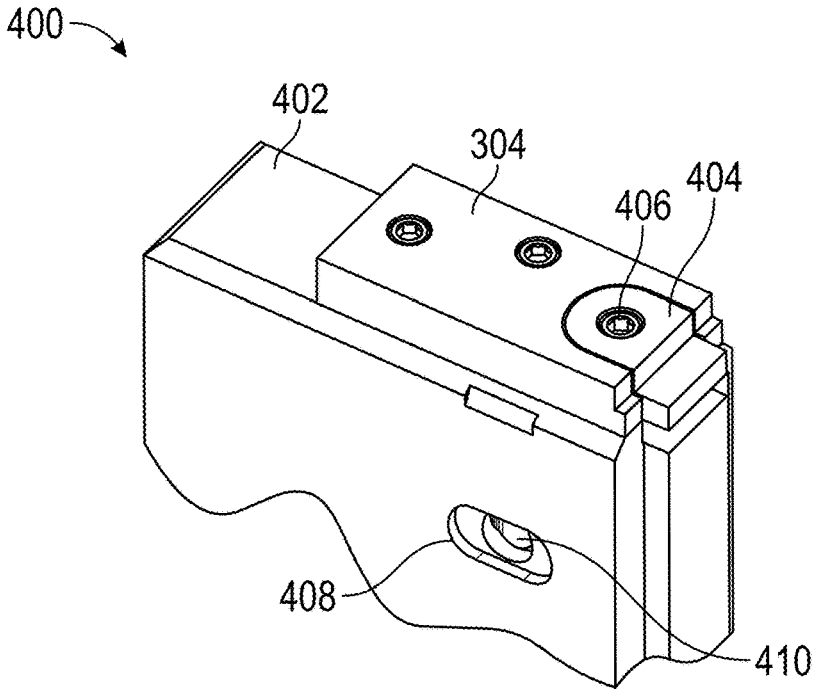
FIGS. 4A-4B are illustrations of the firearm locking device, according to one embodiment.
Figure 4B:
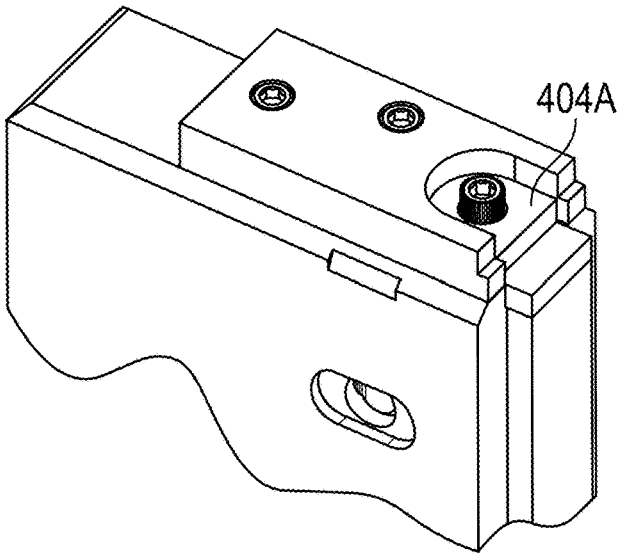

In FIGS. 4A-4B, illustrations of the firearm locking device are shown, according to various embodiments. In this example, a top portion 402 of the firearm locking device 302 is shown. In one example, the top portion 402 of the firearm locking device 302 may include an outside area 408 and an upper receiver pin 410 where the upper rack 310 (upper rack 212 from FIGS. 2B-2C) is coupled to, is engaged with, and/or locks with magazine release lever 106 and/or the firearm 100 to lock the firearm 100 and the firearm locking device 302 together. In another example, the top portion 402 of the locking device 302 may include the carrier bolt blocking unit 304 with a bolt lock plunger 404 and a socket head screw 406. In one example shown in FIG. 4B, a bolt lock plunger 404 may have a step shape which creates an engagement plane for the firearm carrier bolt lock. In various examples, the bolt lock plunger 404 may have various shapes (e.g., an U-shape, square shape, a V-shape, a multi-level shape, an L-shape, an X-shape, etc.) that provide an engagement platform between the bolt lock plunger 404 and the firearm bolt carrier stopper and/or any other part of the bolt.

Figure 5:
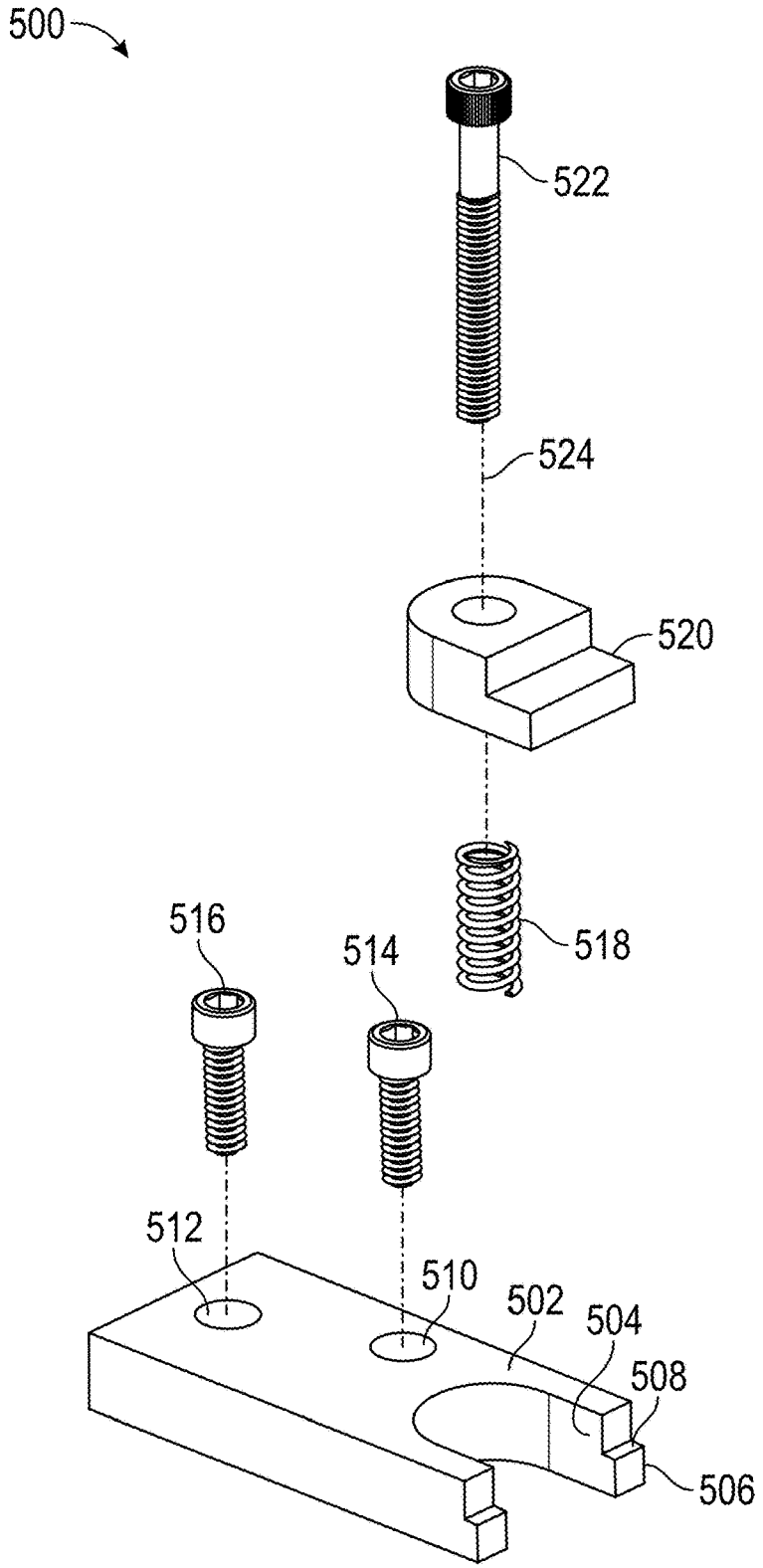
FIG. 5 is an illustration of carrier bolt blocking unit for the firearm locking device, according to one embodiment.

In FIG. 5, an illustration of carrier bolt blocking unit for the firearm locking device is shown, according to one embodiment. In one example, a bolt carrier blocking unit 500 may include a bolt carrier blocking unit plate 502, a plunger cutout area 504, a wall area 506, a plateau 508, a first head screw insertion area 510, a second head screw insertion area 512, a first head screw 514, a second head screw 516, a bolt lock plunger spring 518, a bolt lock plunger 520, and/or plunger socket head screw 522. In this example, the plunger socket head screw 522 is inserted into the bolt lock plunger 520 via an insertion line 524. In one example, the combination of the first head screw insertion area 510, the second head screw insertion area 512, the first head screw 514, and the second head screw 516 secure the carrier bolt blocking unit 500 to the firearm locking device 302. In another example, the bolt lock plunger 520 is positioned into the plunger cutout area 504 where the bolt lock plunger spring 518 allows for movement of the bolt lock plunger 520 in a vertical direction. In one example, a firearm bolt catch 608 (see FIG. 6) may physically contact and/or engage and/or be coupled to the bolt lock plunger 520 of the firearm locking device 320 to prevent a firearm bolt carrier from moving and/or maintaining a position of the firearm bolt carrier.

Figure 6:
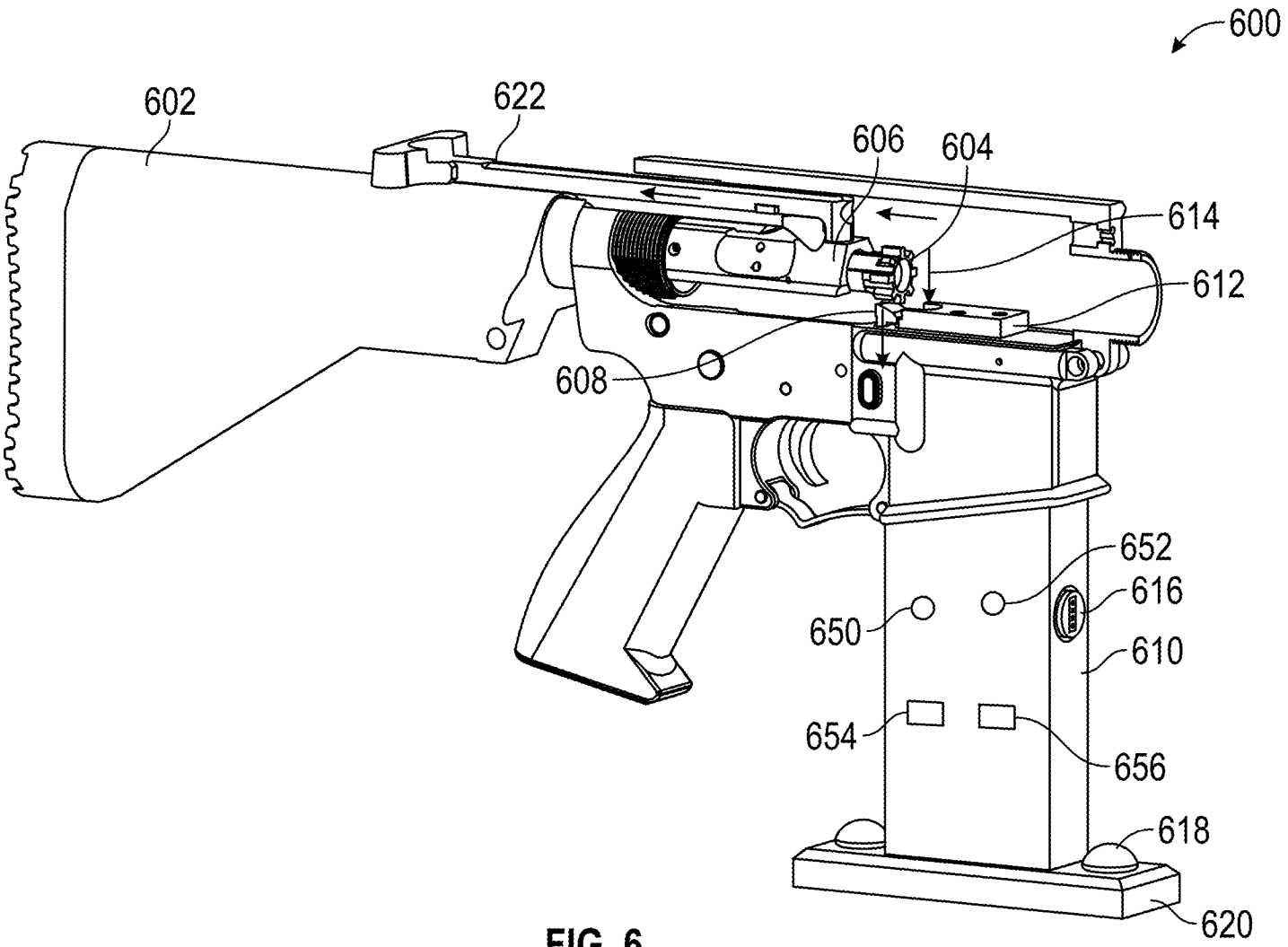
FIG. 6 is an illustration of the firearm locking device and a firearm, according to one embodiment.

In FIG. 6, an illustration of the firearm locking device and a firearm is shown, according to one embodiment. A first image 600 may include a firearm 602 and a firearm locking device 610. In this example, the firearm 602 includes an end of a bolt 604, a bolt carrier 606, and the firearm bolt catch 608. In this example, the firearm locking device 610 includes a bolt carrier blocking unit 612, a bolt lock plunger 614, a locking device 616, a base securing device 618, and a base 620.

In one example, the locking device 616 may be a code locking device where a code is entered (e.g., 3388, 1234, 9999, 4545, etc.) to place the device in a locked state and an unlocked state. In another example, the firearm locking device 610 may include one or more processors 650, one or more sensors 652, one or more transceivers 654, and/or one or more memory units 656. In one example, the one or more sensors 652 may detect any authorized usage and/or any unauthorized usage. For example, the one or more sensors 652 may determine a tapering action (e.g., entering wrong code, force being applied to firearm 602 and/or firearm locking device 610, and/or any other tapering action) is occurring with the firearm 602 and/or the firearm locking device 610. This determination may be stored into the one or more memory units 656 and/or transmit to a remote device (e.g., mobile phone, control center, etc.) via one or more transceivers 654.

In another example, the one or more sensors 652 may determine an authorized usage of the firearm 602. This information may be stored into one or more memory units and/or transmitted to a remote device (e.g., mobile phone, control center, etc.) via one or more transceivers 654). For example, a police officer may remove the firearm 602 from the firearm locking device 610 and this information (e.g., time and day, duration, etc.) may be stored into one or more memory units and/or transmitted to a remote device (e.g., mobile phone, control center, etc.) via one or more transceivers 654. In one example, the control center may utilize this transmitted information to determine whether another course of action should be taken (e.g., send backup officers and/or troops, etc.).

In one example, the bolt carrier group lock action is shown. When the lock assembly is in position the bolt carrier group can be charged by pulling a charge handle 622 back towards the shoulder stock. As the bolt lock passes over the bolt lock plunger and the compression spring, the bolt carrier release lever is forced down allowing passage. After the bolt carrier group passes the bolt carrier release lever and bolt lock plunger, they return due to the spring load of each. When the carrier group travels forward the bolt hits the carrier lock holding the carrier in the charged position. When the lock assembly is removed a magazine can be inserted into the gun. At this time the bolt lock release lever can be used to release the carrier group stripping the top round in the magazine and forcing it into the breach in preparation for firing.

In another example, the bolt carrier group lock action may be modified by the height (e.g., the height would stop and/or make contact with the bolt carrier 606 and/or the end of the bolt 604) of the bolt carrier blocking unit 612. When the lock assembly is in position the bolt carrier group must be locked in the rear position to ensure no bullet could be fired. When the lock assembly is removed a magazine can be inserted into the gun. At this time the bolt lock release lever can be used to release the carrier group stripping the top round in the magazine and forcing it into the breach in preparation for firing.

In the example shown in FIG. 6, the firearm 602 is secured to the firearm locking device 610 and the bolt carrier is locked into position via the interaction between the end of a bolt 604, the bolt carrier 606, the firearm bolt catch 608, and the bolt lock plunger 614. In another example, the firearm bolt catch 608 and the bolt lock plunger 614 are coupled together (e.g., in contact) which holds the firearm bolt catch 608 and the bolt lock plunger 614 in a locked position until the firearm locking device 610 is unlocked, the firearm 602 is removed from the firearm locking device 610, and the bolt carrier release button is engaged (e.g., pressed, pushed, etc.).

In another example, the firearm bolt carrier group may be charged by forcing the bolt lock plunger and the bolt catch to be forced down against the spring load to allow the passage of the bolt carrier group.

Figure 7:
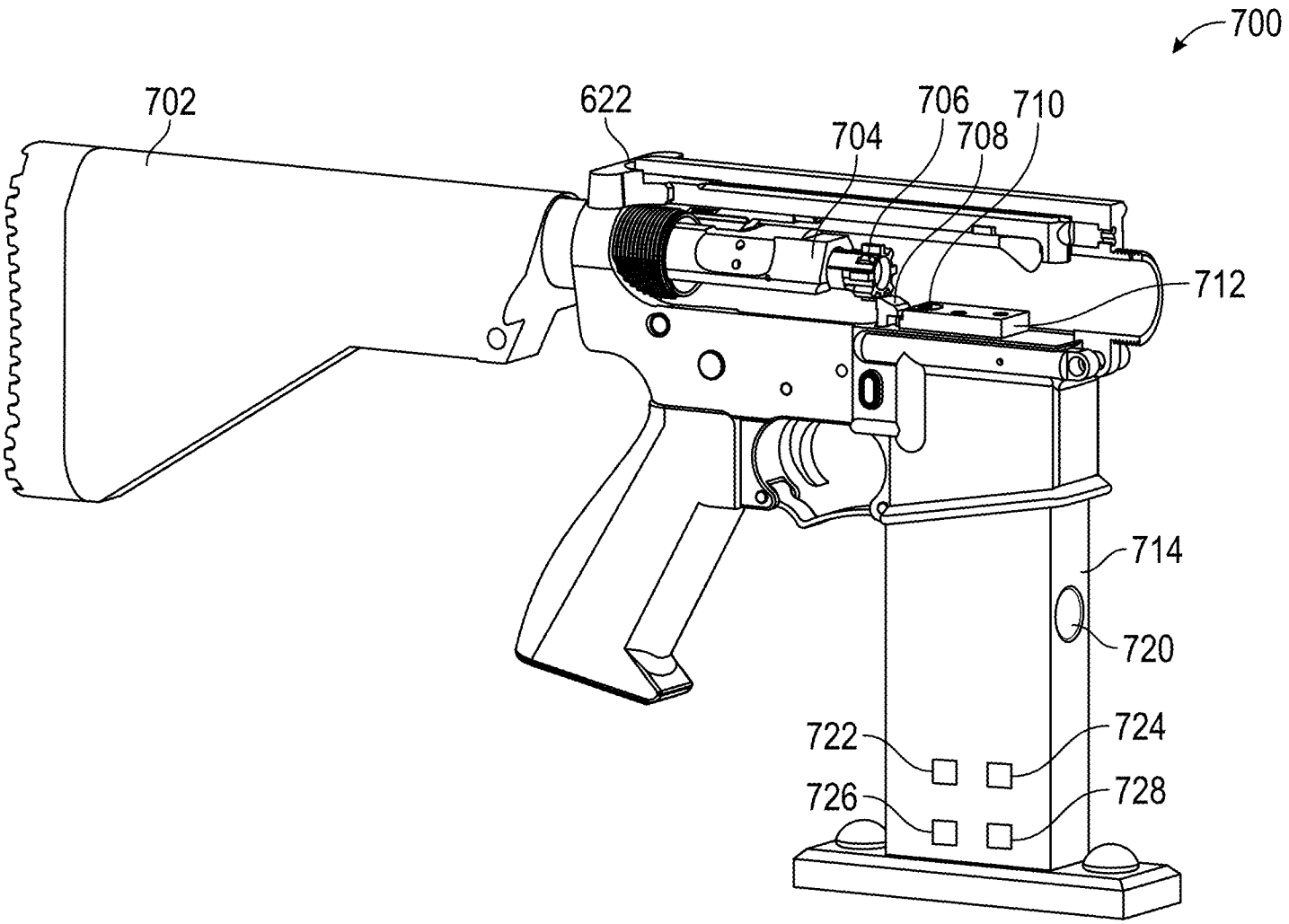
FIG. 7 is an illustration of the firearm locking device and a firearm, according to one embodiment.

In FIG. 7, an illustration 700 of the firearm locking device and a firearm is shown, according to one embodiment. In this example, a firearm 702 and a firearm locking device 714 are shown where the charge handle 622 is shown in a forward position. In this example, the firearm 702 includes a bolt carrier 704, an end of a bolt 706, and a firearm bolt catch 708. In this example, the firearm locking device 714 includes a bolt lock plunger 710 and a bolt carrier blocking unit 712. In the example shown in FIG. 7, the firearm 702 is secured to the firearm locking device 714 and the bolt carrier 704 is locked into position via the interaction between the shaft of the bolt carrier 704, the end of a bolt 706, the firearm bolt catch 708, and the bolt lock plunger 710. In another example, the firearm bolt catch 708 and the bolt lock plunger 614 are coupled together (e.g., in contact) which holds the firearm bolt catch 708 and the bolt lock plunger 614 in a locked position until the firearm locking device 714 is unlocked, the firearm 702 is removed from the firearm locking device 714, and the bolt carrier release button is engaged (e.g., pressed, pushed, etc.).

In one example, the locking device 720 may be a biometric locking device where a biometric data is entered (e.g., finger print, eye data, etc.) to place the device in a locked state and an unlocked state. In another example, the firearm locking device 714 may include one or more processors 722, one or more sensors 724, one or more transceivers 726, and/or one or more memory units 728. In one example, the one or more sensors 724 may detect any authorized usage and/or any unauthorized usage. For example, the one or more sensors 724 may determine a tapering action (e.g., wrong biometric data entered, force being applied to the firearm 702 and/or the firearm locking device 914, and/or any other tapering activity) is occurring with the firearm 702 and/or the firearm locking device 714. This determination may be stored into the one or more memory units 656 and/or transmit to a remote device (e.g., mobile phone, control center, etc.) via one or more transceivers 726.

In another example, the one or more sensors 724 may determine an authorized usage of the firearm 702. This information may be stored into one or more memory units and/or transmitted to a remote device (e.g., mobile phone, control center, etc.) via one or more transceivers 726). For example, a police officer may remove the firearm 702 from the firearm locking device 714 and this information (e.g., finger print data, biometric data, time and day, duration, etc.) may be stored into one or more memory units and/or transmitted to a remote device (e.g., mobile phone, control center, etc.) via one or more transceivers 726. In one example, the control center may utilize this transmitted information to determine whether another course of action should be taken (e.g., send backup officers or troops, etc.). In addition, the bolt carrier group may be stopped by the bolt catch in an up position. In this example, the bolt lock plunger 520 may return to an up position (e.g., level with the top of bolt carrier blocking unit plate 502).

In another example, the bolt carrier group lock action may be modified by the height (e.g., the height would stop and/or make contact with the bolt carrier 704 and/or the end of the bolt 706) of the bolt carrier blocking unit 712. When the lock assembly is in position the bolt carrier group may be locked in the rear position to ensure no bullet is in the firearm's chamber (because of the height of the bolt carrier blocking unit 712—in other words the bolt carrier blocking unit 712 comes into contact with the bolt carrier 704 and/or the end of the bolt 706 and stops the bolt carrier 704 and/or the end of the bolt 706 from moving forward). When the lock assembly is removed a magazine can be inserted into the gun. At this time the bolt lock release lever can be used to release the carrier group stripping the top round in the magazine and forcing it into the breach in preparation for firing.

Figure 8:
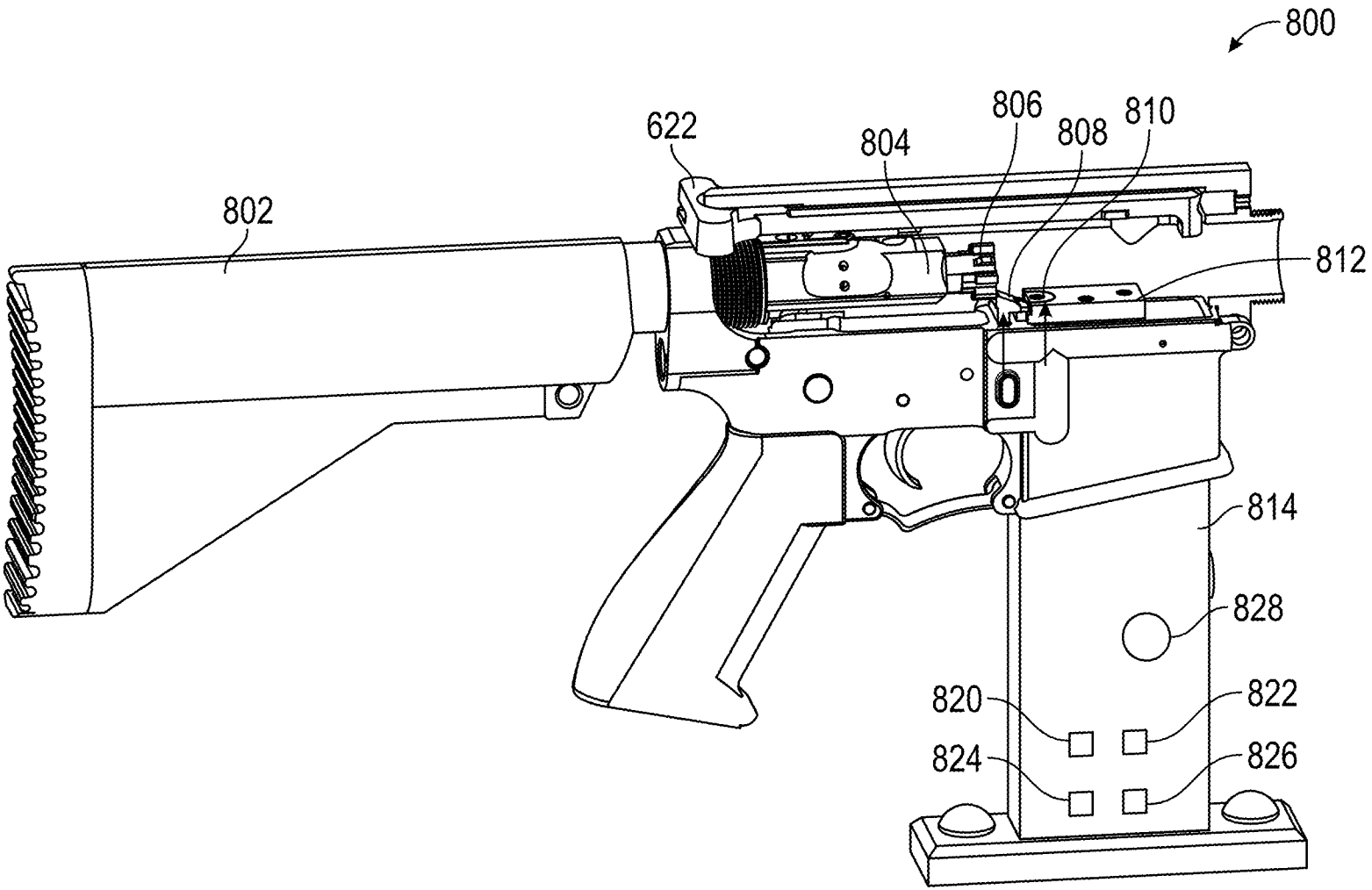
FIG. 8 is an illustration of the firearm locking device and a firearm, according to one embodiment.

In FIG. 8, an illustration 800 of the firearm locking device and a firearm is shown, according to one embodiment. In this example, a firearm 802 and a firearm locking device 814 are shown where the charge handle 622 is shown in a forward position. In this example, the firearm 802 includes a bolt carrier 804, an end of a bolt 806, and a firearm bolt catch 808. In this example, the firearm locking device 814 includes a bolt lock plunger 810 and a bolt carrier blocking unit 812. In the example shown in FIG. 8, the firearm 802 is secured to the firearm locking device 814 and the bolt carrier is locked into position via the interaction between the bolt carrier 804, the end of a bolt 806, the bolt catch 808, and the bolt lock plunger 810. In another example, the firearm bolt catch 808 and the bolt lock plunger 810 are coupled together (e.g., in contact) which holds the firearm bolt catch 808 and the bolt lock plunger 810 in a locked position until the firearm locking device 814 is unlocked, the firearm 802 is removed from the firearm locking device 814, and the bolt carrier release button is engaged (e.g., pressed, pushed, etc.).

In one example, the locking device 616 may be a code locking device, biometric locking device, voice recognition locking device, and/or any other locking device. In another example, the firearm locking device 814 may include one or more processors 820, one or more sensors 822, one or more transceivers 824, one or more memory units 826, and/or one or more cameras 828. In one example, the one or more sensors 822 may detect any authorized usage and/or any unauthorized usage. For example, the one or more sensors 822 may determine a tapering action (e.g., wrong code entered, wrong voice entered, wrong biometric data entered, force being applied to the firearm 702 and/or the firearm locking device 914, and/or any other tapering activity) is occurring with the firearm 802 and/or the firearm locking device 814. This determination may be stored into the one or more memory units 826 and/or transmit to a remote device (e.g., mobile phone, control center, etc.) via one or more transceivers 824.

In another example, the one or more sensors 822 may determine an authorized usage of the firearm 802. This information may be stored into one or more memory units and/or transmitted to a remote device (e.g., mobile phone, control center, etc.) via one or more transceivers 824). For example, a police officer may remove the firearm 802 from the firearm locking device 814 and this information (e.g., time and day, duration, etc.) may be stored into one or more memory units and/or transmitted to a remote device (e.g., mobile phone, control center, etc.) via one or more transceivers 824). In one example, the control center may utilize this transmitted information to determine whether another course of action should be taken (e.g., send backup officers or troops, etc.). In another example, the one or more cameras 828 may be utilized to generate evidence and/or data relating to the unauthorized usage of the firearm 802, tapering activity, and/or any other activity. In another example, the firearm bolt carrier group may be stopped by the firearm bolt catch being in an upper position. In this example, the firearm locking device's bolt lock plunger returns to the upper position because of the spring load.

In another example, the bolt carrier group lock action may be modified by the height (e.g., the height would stop and/or make contact with the bolt carrier 804 and/or the end of the bolt 806) of the bolt carrier blocking unit 812. When the lock assembly is in position the bolt carrier group must be (and/or may be) locked in the rear position to ensure no bullet is in the firearm's chamber. When the lock assembly is removed a magazine can be inserted into the gun. At this time the bolt lock release lever can be used to release the carrier group stripping the top round in the magazine and forcing it into the breach in preparation for firing.

Figure 9:
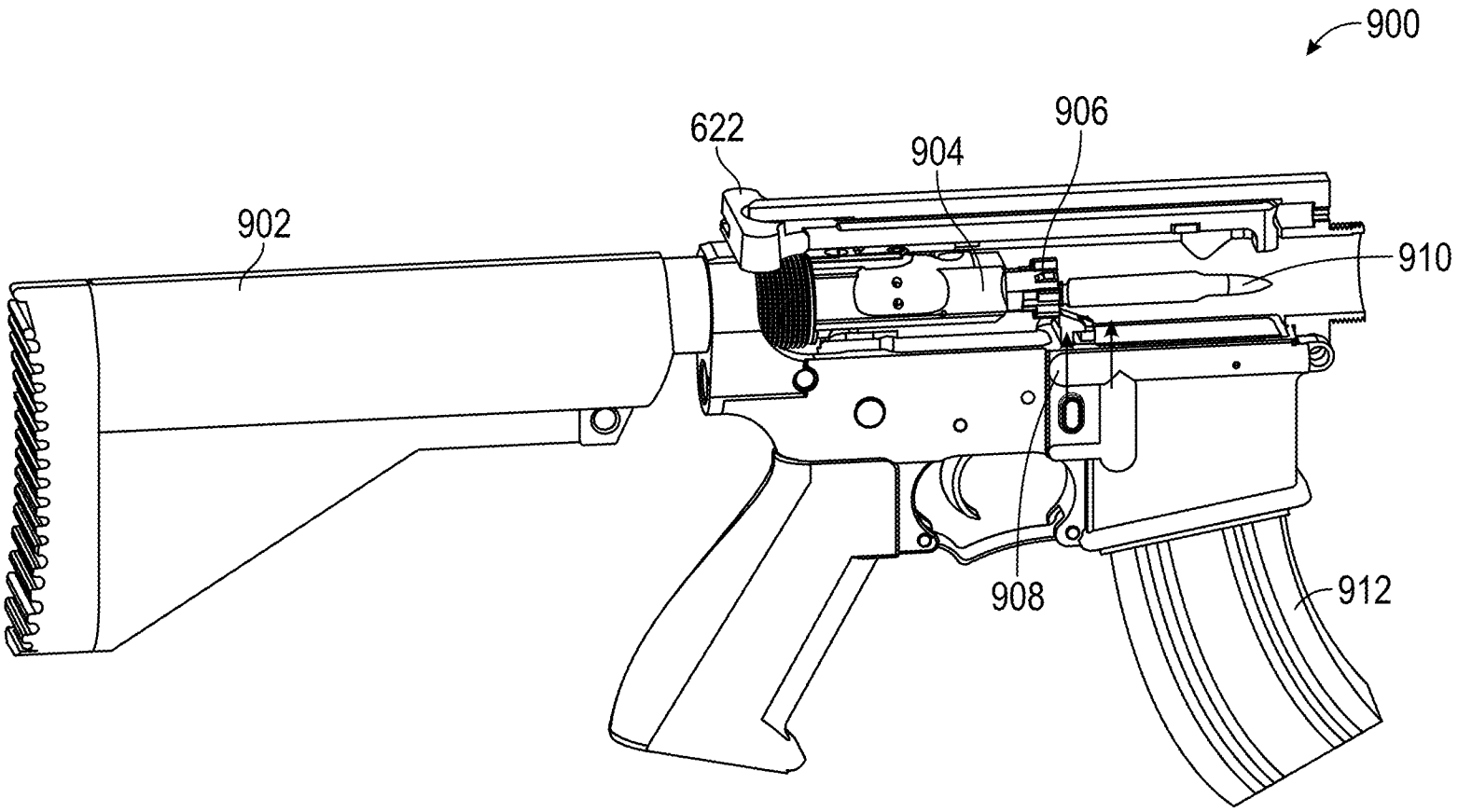
FIG. 9 is an illustration of a bullet being loaded into a chamber, according to one embodiment.

In FIG. 9, an illustration of a bullet being loaded into a chamber is shown, according to one embodiment. A first image 900 shows a firearm 902 where the firearm 902 includes a bolt carrier 904, a bolt carrier end 906, a firearm bolt catch 908, a bullet 910, a magazine 912, and the charge handle 622. In one example, the bullet 910 is obtained from the magazine 912 and the bolt carrier 904 delivers the bullet 910 to the firearm's chamber. In one example, the firearm bolt carrier stays in place because of the interaction with the firearm bolt carrier stopper 908.

Figure 10:
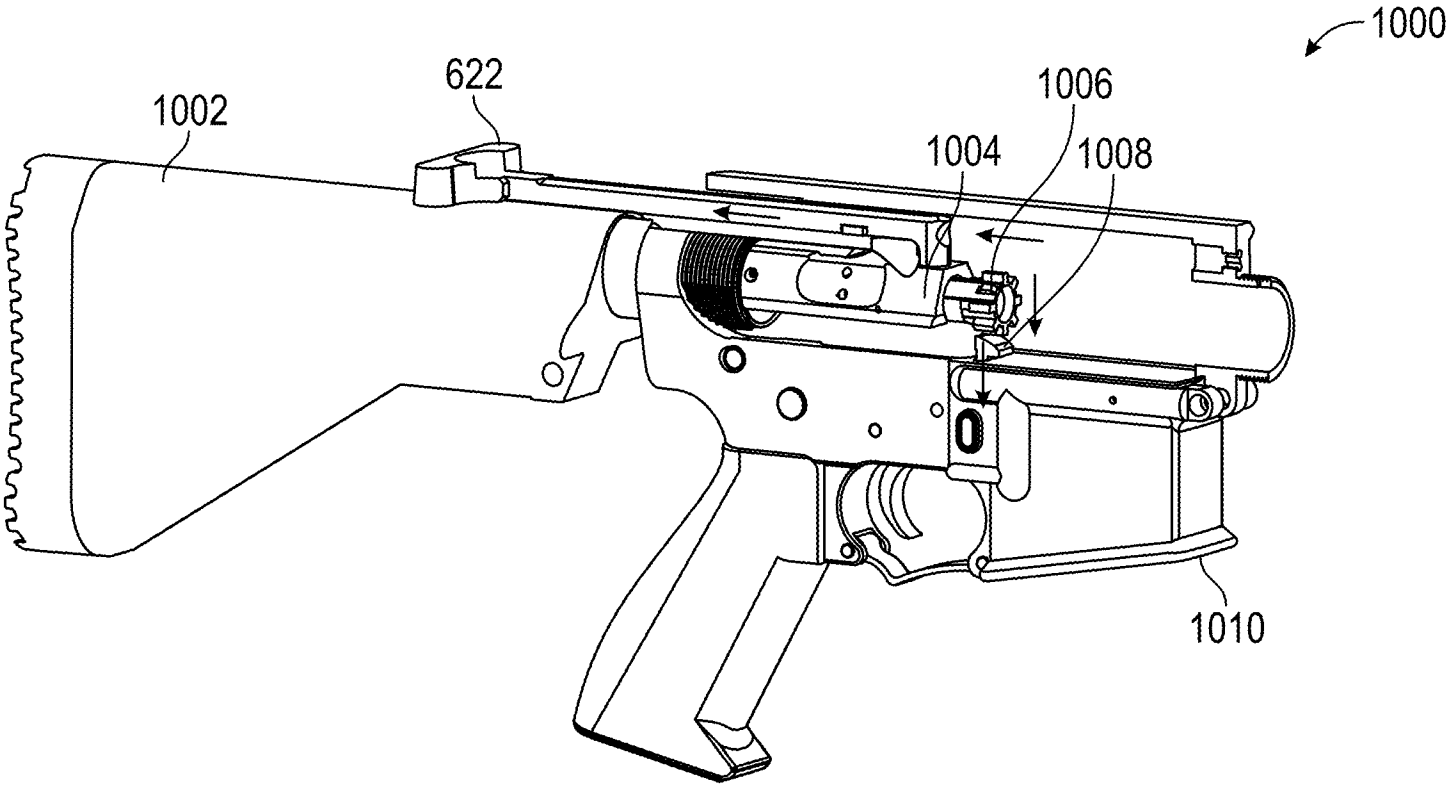
FIG. 10 is an illustration of the firearm locking device and a firearm, according to one embodiment.

In FIG. 10, an illustration of the firearm locking device and a firearm is shown, according to one embodiment. In one example, a first image 1000 shows a firearm 1002 where the firearm 1002 includes a bolt carrier 1004, a bolt carrier end 1006, a firearm bolt carrier stopper 1008, a magazine well 1010, and the charge handle 622. In one example, the firearm bolt carrier stays in place because of the interaction with the firearm bolt carrier stopper 1008.

In one embodiment, a mount for holding and locking a firearm with the firearm having a magazine well and a magazine locking catch extendable through a catch opening into the magazine for locking a magazine in the magazine well. The mount has a surface mountable base and a generally perpendicular extending support mounted to the base. The top portion support is configured to extend into the magazine well of the firearm and has the characteristics of the magazine for the subject firearm. A mount pin is slidably mounted within the top portion of the support and has a first position allowing unlimited movement of the magazine locking catch through the catch opening of the firearm, thus allowing the magazine latching catch to engage the mount in the same manner as it would engage a magazine. The second position of the mount pin engages the magazine locking catch of the firearm pushing the catch from the magazine well into the catch opening of the firearm magazine well which locks the mount to the weapon by preventing the removal of the firearm from the support. A mechanism moves the mount pin from the first position to the second position by the operator when a locking condition is engaged.

In another example, when a magazine is inserted into the magazine well, the magazine will be caught by a lever in the magazine well. The lever limits the movement of the magazine in the magazine well. However, once the magazine release lever 106 is pressed the lever will be withdrawn and the magazine will be able to be removed from the magazine well. In a similar fashion, when the firearm locking device 202 is in an unlocked state and the magazine release lever 106 is pressed, the firearm 100 will be able to be disengaged from the firearm locking device 202.

In one example, the bolt carrier group lock action is shown. When the lock assembly is in position the bolt carrier group can be charged by pulling a charge handle 622 back towards the shoulder stock. As the bolt lock passes over the bolt lock plunger and the compression spring, the bolt carrier release lever is forced down allowing passage. After the bolt carrier group passes the bolt carrier release lever and bolt lock plunger, they return due to the spring load of each. When the carrier group travels forward the bolt hits the carrier lock holding the carrier in the charged (e.g., open) position. When the lock assembly is removed a magazine can be inserted into the gun. At this time the bolt lock release lever can be used to release the carrier group stripping the top round in the magazine and forcing it into the breach in preparation for firing.

In another example, the bolt carrier group lock action may be modified by the height (e.g., the height would stop and/or make contact with the bolt carrier 606 and/or the end of the bolt 604) of the bolt carrier blocking unit 612. When the lock assembly is in position the bolt carrier group is locked in the rear position to ensure no bullet is in the firearm's chamber (because of the height of the bolt carrier blocking unit 712—in other words the bolt carrier blocking unit 712 comes into contact with the bolt carrier 704 and/or the end of the bolt 706 and stops the bolt carrier 704 and/or the end of the bolt 706 from moving forward). When the lock assembly is removed a magazine can be inserted into the gun. At this time the bolt lock release lever can be used to release the carrier group stripping the top round in the magazine and forcing it into the breach in preparation for firing.

Figure 11:
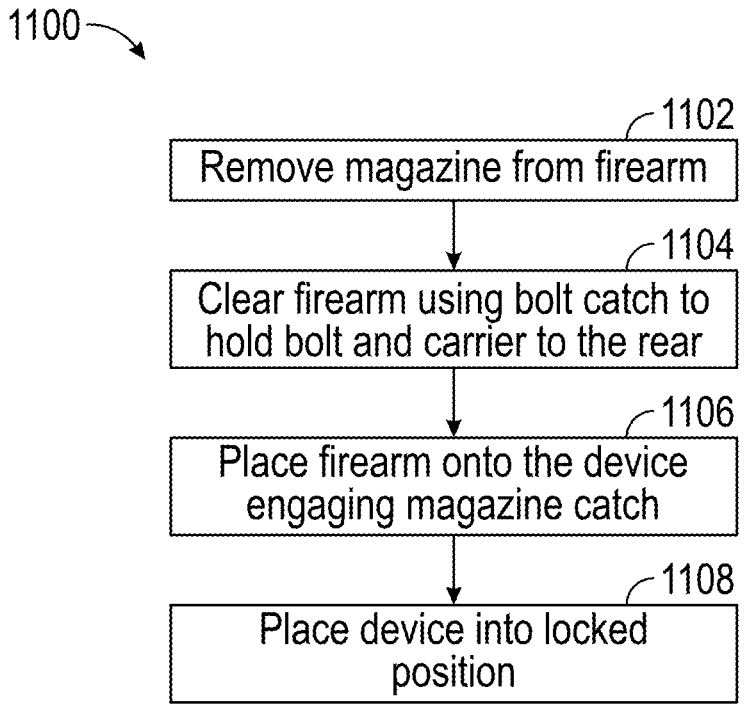
FIG. 11 is a flowchart, according to one embodiment.

In FIG. 11, a flowchart is shown, according to one embodiment. A method 1100 may include removing a magazine from a firearm (step 1102). The method 1100 may include clearing the firearm using the bolt catch to hold the bolt and carrier to the rear (step 1104). The method 1100 may include placing the firearm onto the device and engaging the magazine catch (step 1106). The method 1100 may include placing the device into a locked position (step 1108).

Figure 12:
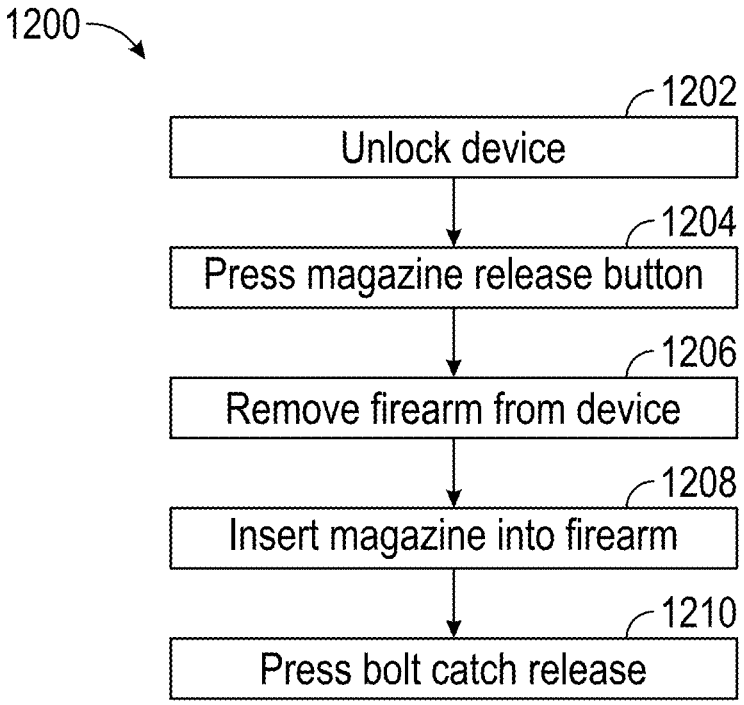
FIG. 12 is a flowchart, according to one embodiment.

In FIG. 12, a flowchart is shown, according to one embodiment. A method 1200 may include unlocking the device (step 1202). The method 1200 may include pressing the magazine release button on the firearm (step 1206). The method 1200 may include inserting a magazine into the firearm (step 1208). The method 1200 may include pressing the bolt catch release button on the firearm (step 1210).

Figure 13:
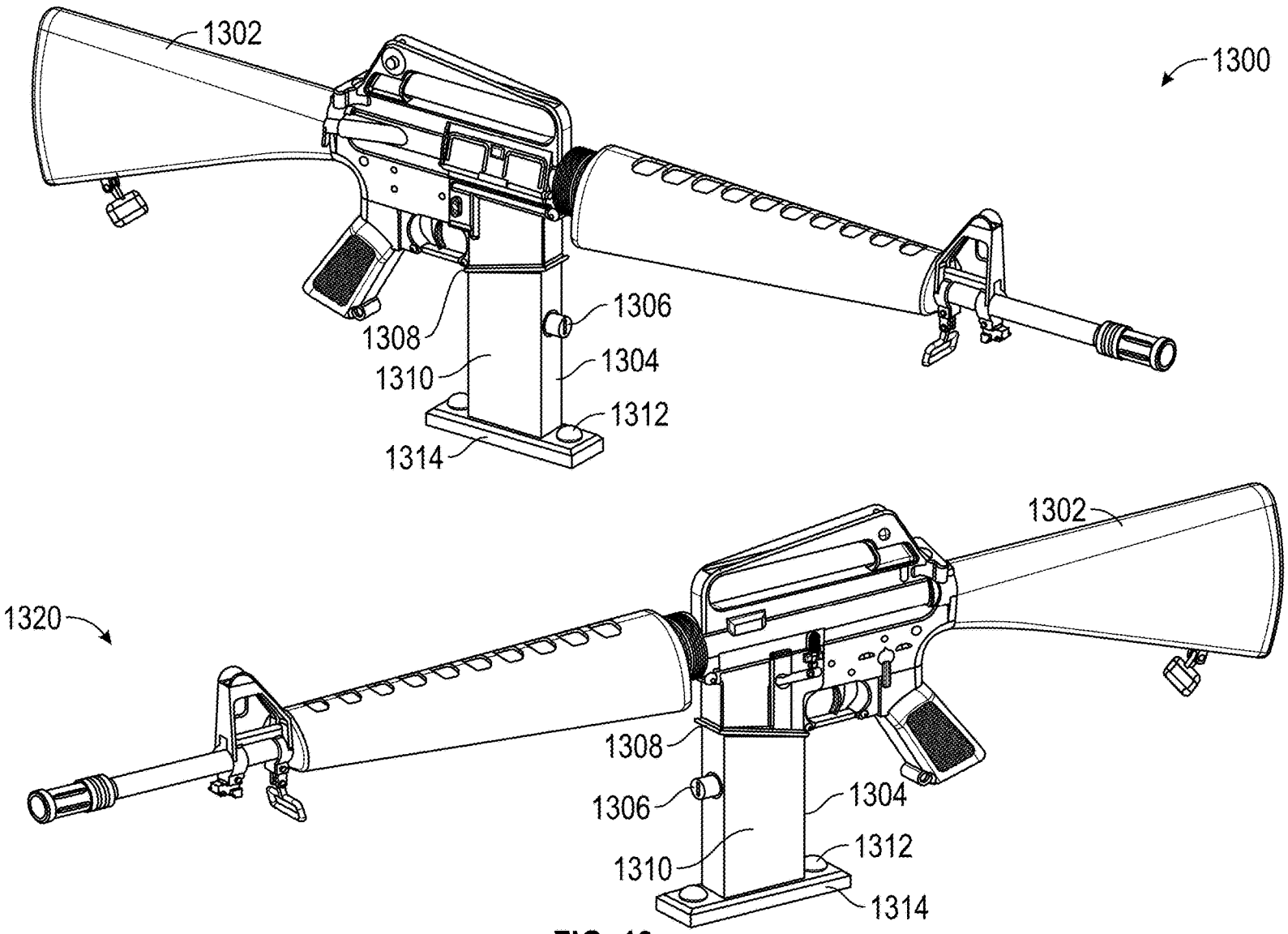
FIG. 13 is an illustration of a firearm locking device and a firearm, according to one embodiment.

In FIG. 13, illustrations of a firearm locking device and a firearm are shown, according to various embodiments. In one example, a first image 1300 shows a firearm 1302 and a firearm locking device 1304. In this example, the firearm 1302 includes a magazine well 1308. Further, the firearm locking device 1304 includes a locking device 1306, a body 1310, one or more securing devices 1312, and a base 1314. In this example, the magazine well 1308 of the firearm 1302 is placed over the firearm locking device 1304 and pushed down to couple the firearm 1302 and the firearm locking device 1304 together.

In one example, a second image 1320 shows the firearm 1302 and the firearm locking device 1304. In this example, the firearm 1302 includes the magazine well 1308. Further, the firearm locking device 1304 includes the locking device 1306, the body 1310, one or more securing devices 1312, and the base 1314. In this example, the magazine well 1308 of the firearm 1302 is placed over the firearm locking device 1304 and pushed down to couple the firearm 1302 and the firearm locking device 1304 together.

In one embodiment, a device may include a body configured to be coupled to a magazine receiving area of a firearm and a locking unit. In addition, the device may include a bolt carrier stopper, a bolt carrier stopper located at a top of the body, a bolt carrier stopper with an engagement area, one or more attachment devices, and/or a base. In one example, a base may be attached to a structure via the one or more attachment devices. In one example, the locking unit may be a code locking unit. In another example, the locking unit may be a biometric locking unit. Further, the locking unit may be a voice recognition system and/or any other locking device.

In another example, the engagement area of the bolt carrier stopper may hold a bolt carrier of the firearm. Further, the engagement area may hold the bolt carrier of the firearm via a bolt catch of the firearm being in contact with the engagement area and/or a firearm bolt carrier stopper.

In another example, the body may include a pinion, a pinion coupled to an upper rack and a lower rack, and/or a key lock pin. In another example, the upper rack may go into a magazine release level area. Further, the locking device may be coupled to the pinion. In addition, the locking device may change a position of the pinion to generate a locked state and an unlocked state for the device. Further, one or more bushing may be coupled to the pinion.

In another example, the device may include a bolt carrier stopper where the bolt carrier stopper includes an engagement area. In this example, the engagement area may be coupled to a gun bolt carrier stopper. In this example, the engagement area has a U-shaped first plane and a rectangular shaped second plane where the rectangular shaped second plane may contact the gun bolt carrier stopper and hold the gun bolt carrier stopper in place.

In another embodiment, a device may include: a body coupled to a magazine receiving area of a firearm where the body includes a pinion coupled to an upper rack and a lower rack; a base and one or more attachment devices to couple the base to a structure; a locking unit where the locking device is coupled to the pinion where the pinion moves the upper rack into a magazine release level area; a bolt carrier stopper located at a top of the body where the bolt carrier stopper includes an engagement area, the engagement area holds a bolt carrier of the firearm; and where the locking device changes a position of the pinion to generate a locked state and an unlocked state for the device.

In another example, a device may include: a body coupled to a magazine receiving area of a firearm where the body includes a pinion coupled to an upper rack and a lower rack; a base and one or more attachment devices coupling the base to a structure; a locking unit where the locking device is coupled to the pinion where the pinion moves the upper rack into a magazine release level area; a bolt carrier stopper located at a top of the body where the bolt carrier stopper includes an engagement area, the engagement area holds a bolt carrier of the firearm; one or more warning sensors configured to detect at least one of authorized actions and unauthorized actions; and/or one or more processors configured to transmit via a transceiver at least one of a warning signal and a status signal; and where the locking device changes a position of the pinion to generate a locked state and an unlocked state for the device.

In one embodiment, a device may include a body configured to be coupled to a magazine receiving area of a firearm and a locking unit. In addition, the device may include a bolt catch, a bolt blocker located at a top of the body, the bolt blocker with an engagement area, one or more attachment devices, and/or a base. In one example, a base may be attached to a structure via the one or more attachment devices. In one example, the locking unit may be a code locking unit. In another example, the locking unit may be a biometric locking unit. Further, the locking unit may be a voice recognition system and/or any other locking device.

In another example, the engagement area of the bolt blocker may hold a bolt carrier of the firearm. Further, the engagement area may hold the bolt carrier of the firearm via a bolt catch of the firearm being in contact with the engagement area and/or a firearm bolt carrier stopper.

In another example, the body may include a pinion, a pinion coupled to an upper rack and a lower rack, and/or a key lock pin. In another example, the upper rack may go into a magazine release level area. Further, the locking device may be coupled to the pinion. In addition, the locking device may change a position of the pinion to generate a locked state and an unlocked state for the device. Further, one or more bushing may be coupled to the pinion.

In another example, the device may include a bolt carrier catch where the bolt catch includes an engagement area. In this example, the engagement area may be coupled to a gun bolt catch stopper. In this example, the engagement area has a U-shaped first plane and a rectangular shaped second plane where the rectangular shaped second plane may contact the gun bolt carrier stopper and hold the gun bolt carrier stopper in place.

In another embodiment, a device may include: a body coupled to a magazine receiving area of a firearm where the body includes a pinion coupled to an upper rack and a lower rack; a base and one or more attachment devices to couple the base to a structure; a locking unit where the locking device is coupled to the pinion where the pinion moves the upper rack into a magazine release level area; a bolt blocker located at a top of the body where the bolt blocker includes an engagement area, the engagement area holds a bolt carrier of the firearm; and where the locking device changes a position of the pinion to generate a locked state and an unlocked state for the device.

In another example, a device may include: a body coupled to a magazine receiving area of a firearm where the body includes a pinion coupled to an upper rack and a lower rack; a base and one or more attachment devices coupling the base to a structure; a locking unit where the locking device is coupled to the pinion where the pinion moves the upper rack into a magazine release level area; a bolt blocker located at a top of the body where the bolt blocker includes an engagement area, the engagement area holds a bolt carrier of the firearm; one or more warning sensors configured to detect at least one of authorized actions and unauthorized actions; and/or one or more processors configured to transmit via a transceiver at least one of a warning signal and a status signal; and where the locking device changes a position of the pinion to generate a locked state and an unlocked state for the device.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

Reference throughout this specification to "one example," "an example," "embodiment," "another example," "in addition," and/or "further" should be considered to mean that the particular features, structures, or characteristics may be combined in one or more examples. Any combination of any element in this disclosure with any other element in this disclosure is hereby disclosed. For example, any element (e.g., the magazine receiving area 104, the magazine release lever 106, the bolt release 108, the base 206, the body 208, and/or the locking device 210, etc.) presented in FIG. 2A may be combined with any and/or all elements in FIG. 7. Therefore, any element disclosed in the specification and/or figures may be combined with any other element disclosed in the specification and/or figures. Therefore, an element in the figures for Figure set 2 may be combined with any and/or all elements in FIG. 12. For brevity, not all figures and/or specification pages are listed in these combination examples but are expressly combinable with each other (e.g., anything (and/or element(s)) in Figure Set 2 with any other figure(s) (and/or element(s)) and/or data from the specification, anything (and/or element(s)) in FIG. 3 with any other figure(s) (and/or element(s)) and/or data from the specification, anything (and/or element(s)) in Figure Set 4 with any other figure(s) (and/or element(s)) and/or data from the specification, anything (and/or element(s)) in Figure Set 6 with any other figure(s) (and/or element(s)) and/or data from the specification, anything (and/or element) in FIG. 6 with any other figure(s) (and/or element(s)) and/or data from the specification, anything (and/or element(s)) in Figure Set 7 with any other figure(s) (and/or element(s)) and/or data from the specification, anything (and/or element(s)) in FIG. 8 with any other figure(s) (and/or element(s)) and/or data from the specification, anything (and/or element(s)) in FIG. 9 with any other figure(s) (and/or element(s)) and/or data from the specification, anything (and/or element(s)) in FIG. 10 with any other figure(s) (and/or element(s)) and/or data from the specification, anything (and/or element(s)) in FIG. 11 with any other figure(s) (and/or element(s)) and/or data from the specification, anything (and/or element(s)) in FIG. 12 with any other figure(s) (and/or element(s)) and/or data from the specification, anything (and/or element(s)) in FIG. 2B with any other figure(s) (and/or element(s)) and/or data from the specification, anything (and/or element(s)) in FIG. 13 with any other figure(s) (and/or element(s)) and/or data from the specification, and/or anything (and/or element(s)) in Figure Set 1 with any other figure(s) (and/or element(s)) and/or data from the specification.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. A device comprising:

a body configured to be coupled to a magazine receiving area of a firearm;

a bolt blocker, the bolt blocker including an engagement area, the engagement area configured to be coupled to a gun bolt blocker; wherein the engagement area is configured to contact a gun bolt carrier stopper and hold the gun bolt blocker in a firearm bolt locked position;

a base and one or more attachment devices to couple the base to a structure, wherein the engagement area has a U-shaped first plane and a rectangular shaped second plane; and a locking device.

2. The device of claim 1, wherein the bolt blocker is located at a top of the body.

3. The device of claim 1, wherein the engagement area is configured to hold a bolt carrier of the firearm via a firearm bolt blocker.

4. The device of claim 1, wherein the engagement area is configured to hold the bolt of the firearm via a bolt catch of the firearm being in contact with the engagement area.

5. The device of claim 1, wherein the body includes a pinion coupled to an upper rack and a lower rack;

wherein the locking device is coupled to the pinion.

6. The device of claim 5, wherein the locking device changes a position of the pinion to generate a locked state and an unlocked state for the device.

7. The device of claim 1, wherein the body further includes a key lock pin.

8. The device of claim 1, further comprising one or more bushing coupled to the pinion.

9. The device of claim 1, further comprising an upper rack configured to enter a magazine release level area.

10. The device of claim 1, wherein the locking unit is a code locking unit.

11. The device of claim 1, wherein the locking unit is a biometric locking unit.

12. The device of claim 1, wherein the locking unit is a voice recognition system.

13. A device comprising:

a body configured to be coupled to a magazine receiving area of a firearm, the body includes a pinion coupled to an upper rack and a lower rack;

a base;

a locking unit;

a bolt blocker located at a top of the body, where the bolt blocker includes an engagement area, the engagement area is configured to hold a bolt of the firearm.

* * * * *